US010730339B2

(12) United States Patent
Shang

(10) Patent No.: US 10,730,339 B2
(45) Date of Patent: Aug. 4, 2020

(54) DECORATIVE CUP

(71) Applicant: Yanyan Shang, Shenzhen (CN)

(72) Inventor: Yanyan Shang, Shenzhen (CN)

( * ) Notice: Subject to any disclaimer, the term of this patent is extended or adjusted under 35 U.S.C. 154(b) by 63 days.

(21) Appl. No.: 16/075,148

(22) PCT Filed: Jun. 8, 2016

(86) PCT No.: PCT/CN2016/085256
§ 371 (c)(1),
(2) Date: Aug. 3, 2018

(87) PCT Pub. No.: WO2017/210890
PCT Pub. Date: Dec. 14, 2017

(65) Prior Publication Data
US 2019/0061415 A1 Feb. 28, 2019

(51) Int. Cl.
*F04D 29/42* (2006.01)
*F04D 29/46* (2006.01)
(Continued)

(52) U.S. Cl.
CPC ..... *B44C 5/00* (2013.01); *A47G 19/22* (2013.01); *A47G 19/2227* (2013.01); *B05B 17/08* (2013.01); *F04D 13/08* (2013.01); *F04D 29/426* (2013.01); *F04D 29/468* (2013.01); *A47G 2019/2238* (2013.01); *A47G 2200/08* (2013.01)

(58) Field of Classification Search
CPC ..... A47G 19/22; A47G 19/2227; A47G 2019/2238; A47G 2200/08; B44C 5/00; F04D 13/08; F04D 29/426; F04D 29/468; B05B 17/08
See application file for complete search history.

(56) References Cited

U.S. PATENT DOCUMENTS 1,536,188 A * 5/1925 Brown ..... G09F 13/24 40/406
5,109,620 A * 5/1992 Torrence ..... G09F 19/12 239/17
(Continued)

FOREIGN PATENT DOCUMENTS

CN 2868117 Y 2/2007
CN 2936072 Y 8/2007
(Continued)

OTHER PUBLICATIONS

Qingna Li, the International Searching Authority written comments, dated Mar. 2017, CN.
Qingna Li, the International Search Report, dated Mar. 2017, CN.

*Primary Examiner* — Darren W Gorman

(57) ABSTRACT

The present disclosure provides a decorative cup. The decorative cup includes a shell. The shell includes a cup body and a base. The cup body includes an accommodating portion and a transparent portion. A cavity is formed in the base. The accommodating portion is disposed in the cavity. The transparent portion is made of a transparent material, and shaped as a polygon prism. The transparent portion may enable light rays to be reflected for multiple times on the cup body because of the polygon prism structure of the transparent portion, so that the cup body looks more crystal clear and more dazzling, thereby greatly improving the ornamental value of the decorative cup.

16 Claims, 8 Drawing Sheets

(51) Int. Cl.

| | |
|---|---|
| ***B05B 17/08*** | (2006.01) |
| ***F04D 13/08*** | (2006.01) |
| ***B44C 5/00*** | (2006.01) |
| ***A47G 19/22*** | (2006.01) |

(56) References Cited

U.S. PATENT DOCUMENTS

| | | | | |
|---|---|---|---|---|
| 6,053,422 | A * | 4/2000 | Polzin, Jr. ..... | A63J 21/00 239/17 |
| 6,530,530 | B1 * | 3/2003 | Peterson ..... | B05B 17/08 222/78 |
| 2014/0353339 | A1 | 12/2014 | Madjar | |

FOREIGN PATENT DOCUMENTS

| | | | |
|---|---|---|---|
| CN | 200994701 | Y | 12/2007 |
| CN | 201325272 | Y | 10/2009 |
| CN | 201452596 | U | 5/2010 |
| CN | 201491610 | U | 6/2010 |
| CN | 202604381 | U | 12/2012 |
| CN | 203098304 | U | 7/2013 |
| CN | 103504956 | A | 1/2014 |
| CN | 105011684 | A | 11/2015 |
| CN | 10504901 | A | 8/2016 |
| CN | 105942791 | A | 9/2016 |
| CN | 205686052 | U | 11/2016 |
| CN | 205947584 | U | 2/2017 |
| DE | 102014104594 | A1 | 10/2015 |
| JP | 2003291595 | A | 10/2003 |

* cited by examiner

DECORATIVE CUP

TECHNICAL FIELD

The present disclosure relates to the field of living goods, and more particularly to a decorative cup.

BACKGROUND

Nowadays, in human life, decorations are becoming more and more necessary on desktops of people. General decorations are all fixed, and are low in ornamental value. Existing decorative cups are all made of colored non-transparent plastics, so that ornamental effects at night or in relatively dark places are poor, and optical decoration is lacked.

SUMMARY

To solve the technical problems, the present disclosure provides a decorative cup capable of better reflecting light rays.

The purpose of the present disclosure is achieved by the following technical solution:

a decorative cup includes a shell. The shell includes a cup body and a base. The cup body includes an accommodating portion and a transparent portion. A cavity is formed in the base. The accommodating portion is disposed in the cavity. The transparent portion is made of a transparent material and shaped as a polygon prism.

Further, the base includes an upper cover. A placement hole matched with the accommodating portion is formed in the upper cover. A limiting column is disposed on the transparent portion. A limiting hole matched with the limiting column is formed in the upper cover. A threaded hole is formed in the limiting column. In this way, after being mounted in the cavity through the placement hole of the upper cover, the accommodating portion is perfectly shielded, thereby making the decorative cup simpler and more beautiful in appearance, and greatly improving the ornamental value of the decorative cup. The limiting column is inserted into the limiting hole, and the limiting hole limits and fixes the limiting column, so that the cup body may be well prevented from moving, and fixed to the upper cover very steadily. By matching of a screw and the threaded hole, the screw may fix the cup body to the upper cover very firmly. Meanwhile, this fixing mode is very convenient for removal, so that the cup body may be very conveniently removed for cleaning or repairing, and the decorative cup is more durable and very convenient to use.

Further, the base includes a lower cover. Heat dissipation holes are formed in the lower cover at intervals. The heat dissipation holes are disposed around the lower cover by one circle. Supporting protrusions 127 are also disposed on the lower cover 123. Three supporting protrusions 127 are disposed at intervals. A water pump apparatus is disposed in an accommodating cavity. The water pump apparatus includes a water pump shell. A motor is disposed in the water pump shell. In this way, through the arrangement of the heat dissipation holes, heat dissipation may be well performed on the water pump apparatus, so that the water pump apparatus may work in a very efficient and good way. As the heat dissipation holes are disposed around the lower cover by one circle, the decorative cup is higher in heat dissipation efficiency, and may perform the heat dissipation on the water pump apparatus more quickly to guarantee normal work of the water pump apparatus. The arrangement of the supporting protrusions facilitates placement of the decorative cup, and may effectively prevent the decorative cup from sliding, so as to guarantee stable placement of the decorative cup. By the three supporting protrusions, the decorative cup is placed more stably. The water pump shell may also provide a good protection for the motor to effectively prevent the motor from being pressed, thereby making the motor more durable.

Further, a motor baffle plate is disposed on the water pump shell. A blade enclosure is disposed on the motor baffle plate. A first through hole is formed in the blade enclosure. A blade fixing cover is disposed on the blade enclosure in a matched manner. A guide groove matched with the first through hole is formed in the blade fixing cover. In this way, through the arrangement of the motor baffle plate, the motor is very convenient to mount and limit, and may be limited perfectly. The arrangement of the blade enclosure may provide a good protection for blades to enable the blades to be more durable, and may provide a very good support for the water pump shell to further improve the rigidity of the water pump shell. The arrangement of the blade fixing cover also may provide a very good protection for the blades to effectively prevent the blades from being damaged and greatly improve the durability of the blades. Due to the first through hole, water is very convenient to flow. The guide groove and the first through hole are matched with each other to enable the water pump apparatus to work more efficiently.

Further, a guide protrusion is disposed on the blade fixing cover and is disposed along an edge of the guide groove. The guide protrusion is configured in an arc shape. A second through hole is formed in the blade fixing cover. The first through hole is communicated with the second through hole in a matched manner. In this way, the guide protrusion may well guide the water to a place near the motor, so that it is more convenient for the work of the blades. As the guide protrusion is disposed along the edge of the guide groove, it is very convenient for processing and production of the blade fixing cover and convenient for die opening manufacturing of the blade fixing cover, and the production cost is greatly reduced. The arc-shaped guide protrusion may well reduce the resistance of the water, so that the water may flow to a place near the blades better to facilitate the cooperative work of the motor and the blades.

Further, a shifting block is disposed on the water pump shell, and includes a shifting block baffle plate. A shifting block inserting column is disposed on the shifting block baffle plate. A baffle plate inserting hole matched with the shifting block inserting column is formed in the motor baffle plate. In this way, the shifting block inserting column and the baffle plate inserting hole are matched to limit the shifting block perfectly. Furthermore, the shifting block inserting column may do a rotating motion very easily in the baffle plate inserting hole, thereby greatly facilitating the operation of the shifting block. The shifting block baffle plate and the water pump shell are matched to greatly facilitate removal, cleaning or replacement of the shifting block, so that the shifting block is more durable.

Further, the water pump shell includes a front fixed cover. A handle through hole is formed in the front fixed cover. A shifting block handle matched with the handle through hole is disposed on the shifting block. The shifting block baffle plate is matched with the second through hole. The shifting block handle controls the movement of the shifting block baffle plate. In this way, the front fixed cover may well press and fix the shifting block, so that the shifting block may be perfectly limited and fixed by the front fixed cover. The shifting block handle and the handle through hole are matched, so that the shifting block handle is very convenient to operate. Furthermore, the handle through hole may well limit the shifting block handle to effectively limit a motion range of the shifting block handle, so that the shifting block may be operated more conveniently and easily. The shifting block handle is operated to enable the shifting block baffle plate to shield the second through hole in different degrees, thereby well controlling the outflow of the water flowing out from the second through hole to well control a fluctuation caused by the water flow on a water surface, so that a more lifelike ornamental effect is simulated.

Further, the water pump shell includes a rear fixed cover. A buckling protrusion is disposed on the rear fixed cover. A buckling groove matched with the buckling protrusion is formed in the water pump shell. Diversion through holes are formed in the front fixed coven A plurality of diversion through holes are disposed along the front fixed cover. The rear fixed cover includes a first rear cover and a second rear cover. A rear cover through hole is formed in the first rear cover. In this way, the buckling protrusion and the buckling groove are matched with each other to fix the rear fixed cover very firmly. The rear fixed cover may well shield the inside of the water pump shell, so that the water pump apparatus looks cleaner and tidier and more beautiful, and the decorative cup is higher in ornamental value. The rear fixed cover is disassembled into the first rear cover and the second rear cover, so that the rear fixed cover may be better used. A connecting wire connected with the motor may be connected with the motor through the rear cover through hole, so that the second rear cover is not required to be removed if a wire connecting condition is required to be maintained, which makes the maintenance operation very convenient and easy. The diversion through holes may well divide the water flow formed by the water pump apparatus to enable the water flow to be dispersed more uniformly and form a relatively uniform fluctuation on the water surface, so that the decorative cup is higher in ornamental value. Through the arrangement of the plurality of diversion through holes, a better diversion effect is achieved and a better ornamental effect is generated.

Further, a water pump fixing frame is disposed on the water pump shell, and includes supporting columns and fixing buckles. The fixing buckles are matched with the water pump shell, and the supporting columns are matched with the shell, so as to clamp and fix the water pump shell. In this way, the water pump fixing frame may fix the water pump shell to the shell perfectly to effectively fix and limit the water pump apparatus. The supporting columns may provide a good support for the water pump apparatus to enhance the supporting for the water pump apparatus and effectively prevent the water pump apparatus from being pressed and damaged, thereby protecting the water pump apparatus very effectively. The fixing buckles firmly fix the water pump apparatus with the water pump fixing frame, thereby better protecting the water pump apparatus. Meanwhile, this fixing mode is very convenient for removal of the water pump apparatus, so that the water pump apparatus is very convenient and easy to maintain.

Further, the decorative cup includes a circuit board. Light emitting diode (LED) lamps are disposed on the circuit board. At least two LED lamps are disposed. The LED lamps may be designed in different colors respectively. In this way, if pure water or tap water is accommodated in the decorative cup, the cup body is more crystal clear through irradiation of the LED lamps, so that the ornamental value of the decorative cup is improved. Through the irradiation of the LED lamps with different colors, the decorative cup presents different colors, so that the decorative cup is more colorful and higher in ornamental value.

According to the present disclosure, through the arrangement of the transparent portion, the decorative cup looks simpler and more beautiful in appearance. When the pure water is injected into the decorative cup, light rays irradiate water through the cup body. The transparent portion may enable the light rays to be reflected for multiple times on the cup body because of the polygon prism structure of the transparent portion, so that the cup body looks more crystal clear and more dazzling, thereby greatly improving the ornamental value of the decorative cup. The accommodating portion may be well shielded and hidden through the arrangement of the cavity, so that the decorative cup is simpler and more beautiful in appearance.

Figure 1:
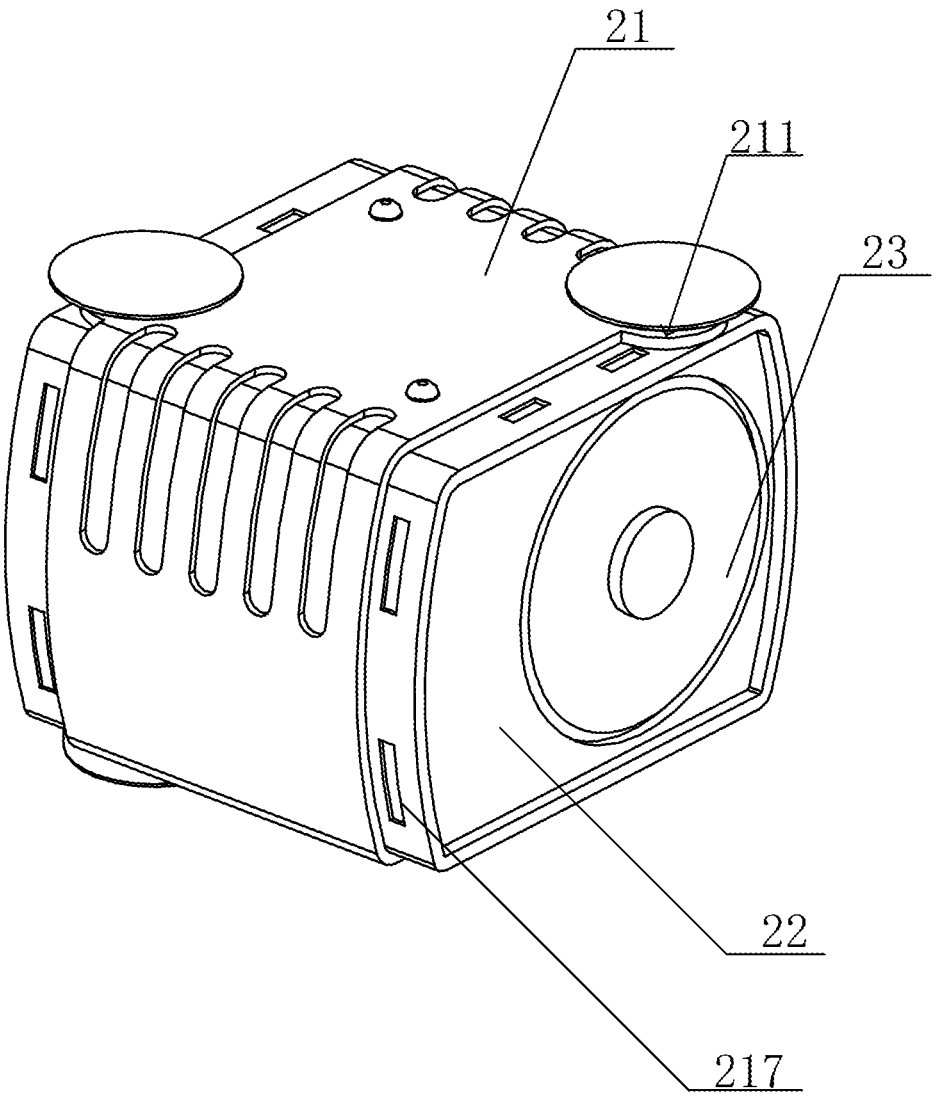
FIG. 1 is a structural schematic diagram of a water pump apparatus according to an embodiment of the present disclosure.
Figure 2:
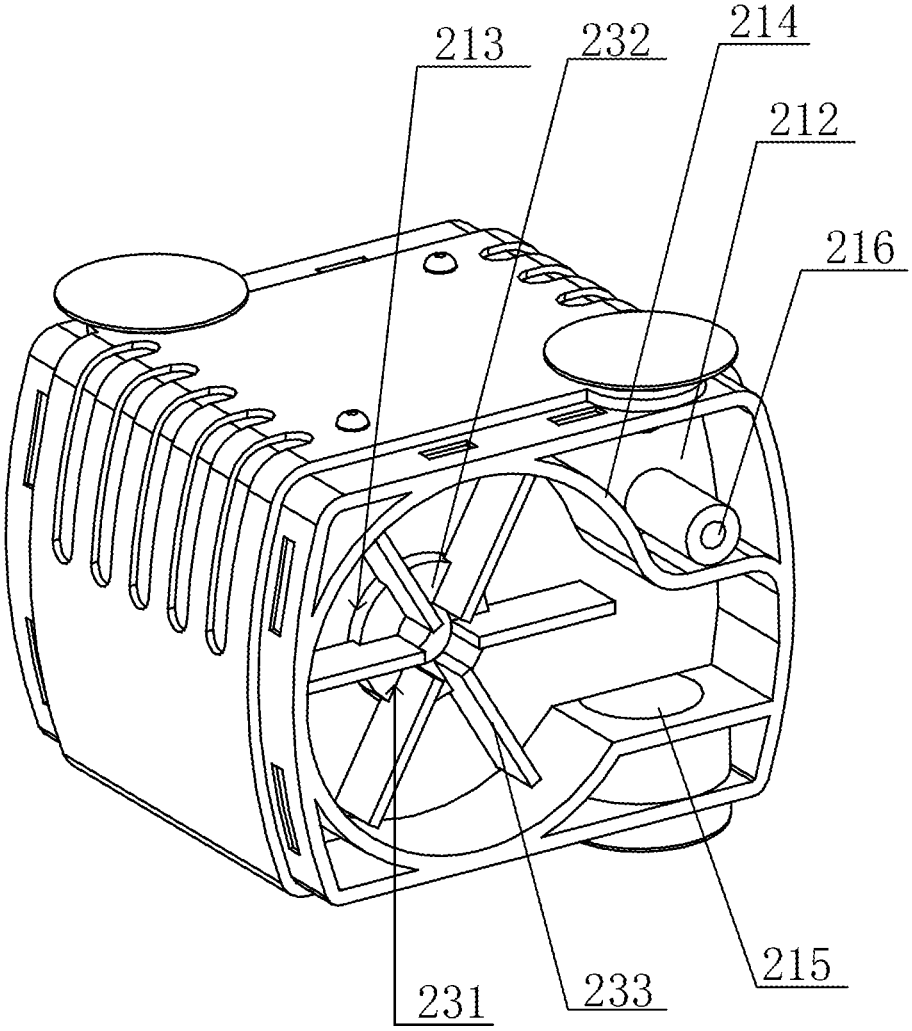
FIG. 2 is a structural schematic diagram of a water pump apparatus according to an embodiment of the present disclosure.
Figure 3:
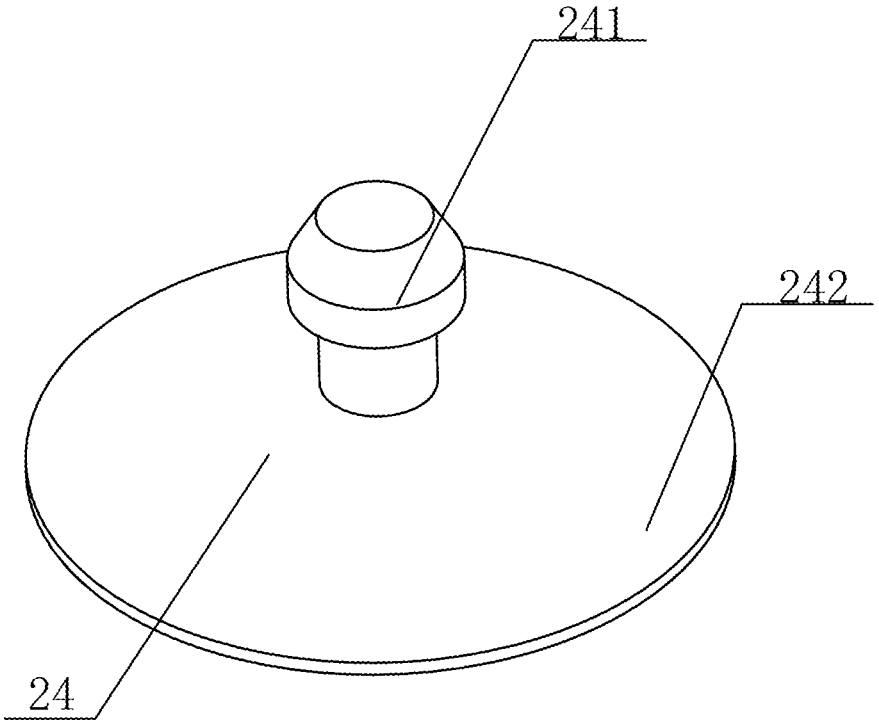
FIG. 3 is a structural schematic diagram of an non-slip rubber pad according to an embodiment of the present disclosure.
Figure 4:
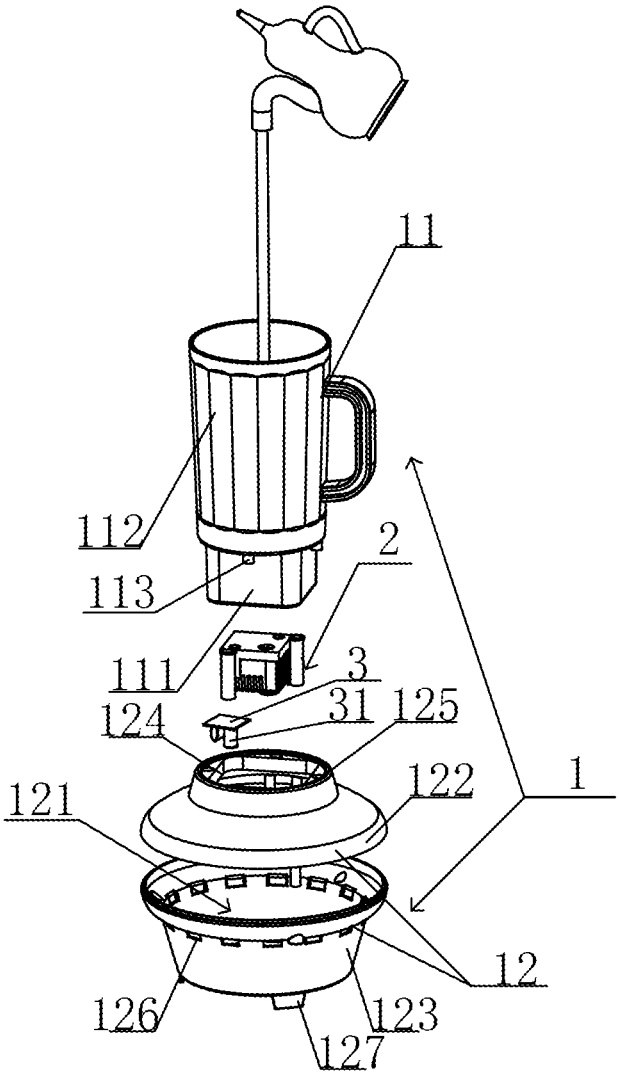
FIG. 4 is an exploded diagram of a decorative cup according to an embodiment of the present disclosure.
Figure 5:
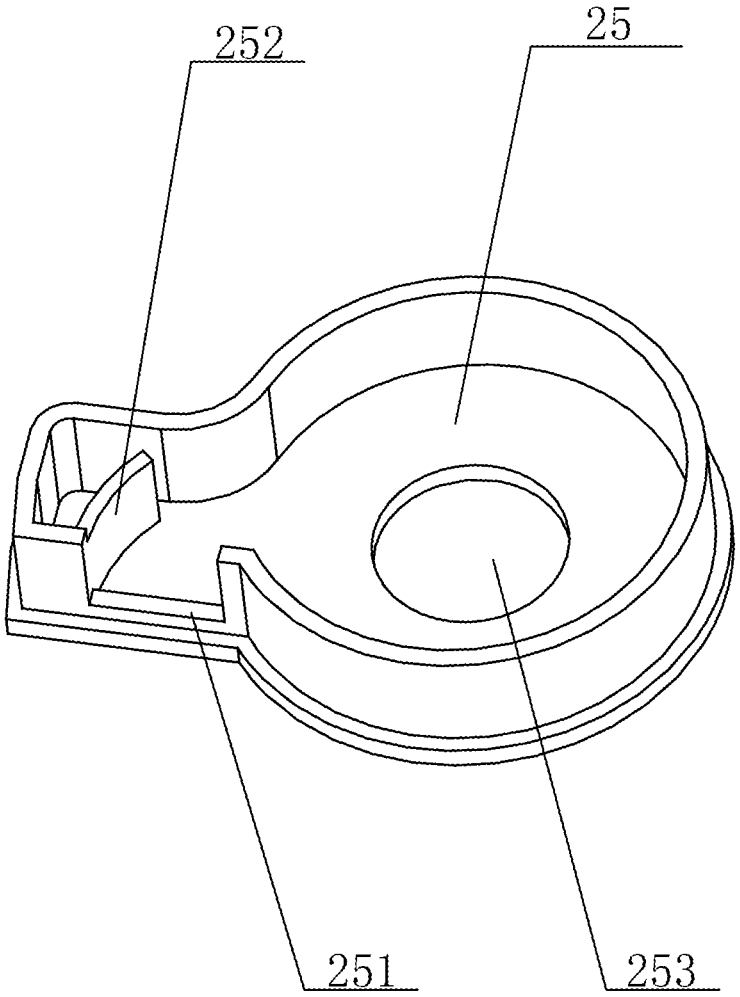
FIG. 5 is a structural schematic diagram of a blade fixing cover according to an embodiment of the present disclosure.
Figure 6:
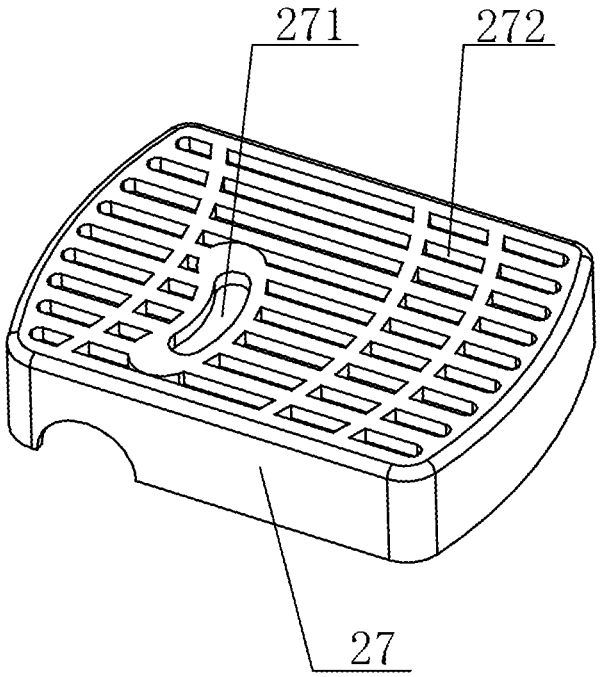
FIG. 6 is a structural schematic diagram of a front fixed cover according to an embodiment of the present disclosure.
Figure 7:
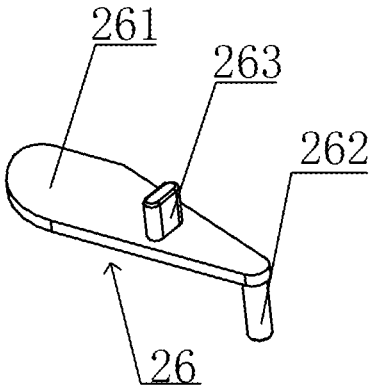
FIG. 7 is a structural schematic diagram of a shifting block according to an embodiment of the present disclosure.
Figure 8:
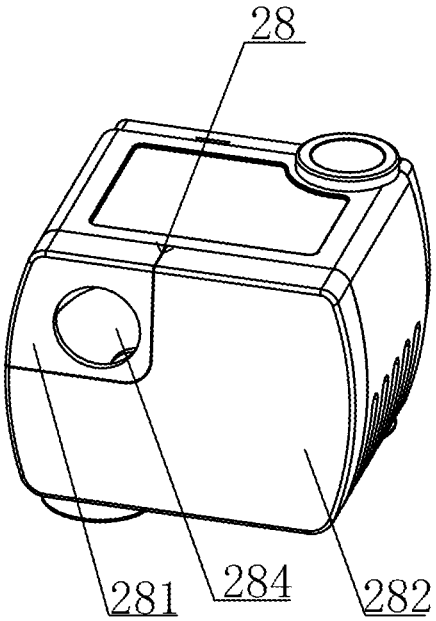
FIG. 8 is a structural schematic diagram of a rear fixed cover according to an embodiment of the present disclosure.
Figure 9:
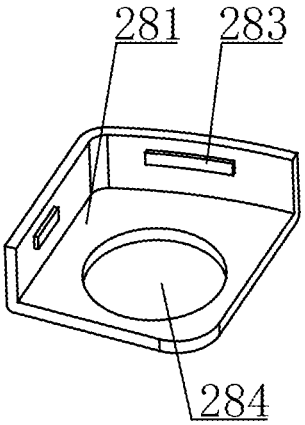
FIG. 9 is a structural schematic diagram of a first rear cover according to an embodiment of the present disclosure.
Figure 10:
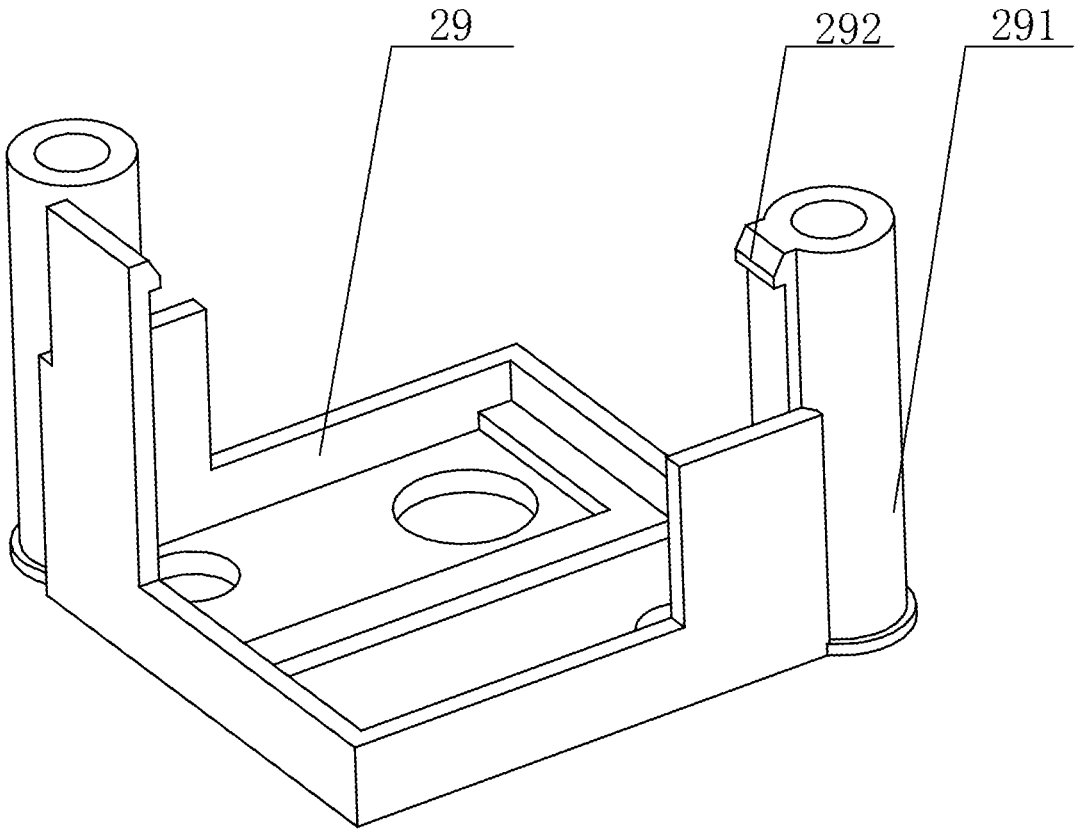
FIG. 10 is a structural schematic diagram of a water pump fixing frame according to an embodiment of the present disclosure.

In the figures. 1 shell; 11 cup body; 111 accommodating portion; 112 transparent portion; 113 limiting column; 12 base; 121 cavity; 122 upper cover; 123 lower cover; 124 placement hole; 125 limiting hole; 126 heat dissipation hole; 127 supporting protrusion; 2 water pump apparatus; 21 water pump shell; 211 fixing hole; 212 motor baffle plate; 213 baffle plate through hole; 214 blade enclosure; 215 first through hole; 216 baffle plate inserting hole; 217 buckling groove; 22 shock absorption layer; 23 motor; 231 blade portion; 232 fixed protrusion; 233 blade; 24 non-slip rubber pad; 241 limiting protrusion; 242 suction disk portion; 25 blade fixing cover; 251 guide groove; 252 guide protrusion; 253 second through hole; 26 shifting block; 261 shifting block baffle plate; 262 shifting block inserting column; 263 shifting block handle; 27 front fixed cover; 271 handle through hole; 272 diversion through hole; 28 rear fixed cover; 281 first rear cover; 282 second rear cover; 283 buckling protrusion; 284 rear cover through hole; 29 water pump fixing frame; 291 supporting column; 292 fixing buckle; 3 circuit board; and 31 LED lamp.

DETAILED DESCRIPTION

In the description of the present disclosure, it should be understood that orientations or position relationships indicated by terms "center", "transverse", "up", "down", "left", "right", "vertical", "horizontal", "top", "bottom", "inside" and "outside" are orientations or position relationships as shown on the basis of the accompanying drawings, and are only used to facilitate and simplify the description of the present disclosure, instead of expressing or implying that indicated apparatuses or elements must have specific orientations and be constructed and operated in the specific orientations, so these terms should not be understood as limiting the present disclosure. In addition, terms "first" and "second" are only for description, and should not be understood as expressing or implying relative importance or impliedly indicating the number of technical features. Therefore, features defined by "first" and "second" may explicitly or impliedly include one or more of these features. In the description of the present disclosure, unless otherwise specified, "a plurality of" means two or more than two. In addition, the term "include" and any variations of "include" are intended to cover non-exclusive inclusions.

In the description of the present disclosure, it should be noted that unless otherwise clearly specified and defined, terms "mounting", "connected" and "connecting" shall be understood in a broad sense. For example, it may be fixed connection, and also may be detachable connection, or integrated connection. It may be mechanical connection, and also may be electric connection. It may be direct connection, and also may be indirect connection through an intermediate. It may be communication of insides of two elements. Those ordinarily skilled in the art can understand specific meanings of the above-mentioned terms in the present disclosure according to specific situations.

The present disclosure will be further described below in combination with accompanying drawings and preferred embodiments.

As shown in FIG. 1 to FIG. 10, the present embodiment discloses a decorative cup. The decorative cup includes a shell 1. The shell 1 includes a cup body 11 and a base 12. The cup body 11 includes an accommodating portion 111 and a transparent portion 112. A cavity 121 is formed in the base 12. The accommodating portion 111 is disposed in the cavity 121. The transparent portion 112 is made of a transparent material and shaped as a polygon prism. Through the arrangement of the transparent portion 112, the decorative cup looks simpler and more beautiful in appearance. When pure water is injected into the decorative cup, light rays irradiate water through the cup body 11. The transparent portion 112 may enable the light rays to be reflected for multiple times on the cup body 11 because of the polygon prism structure of the transparent portion 112, so that the cup body 11 looks more crystal clear and more dazzling, thereby greatly improving the ornamental value of the decorative cup. The accommodating portion 111 may be well shielded and hidden through the arrangement of the cavity 121, so that the decorative cup is simpler and more beautiful in appearance.

The base 12 includes an upper cover 122. A placement hole 124 matched with the accommodating portion 111 is formed in the upper cover 122. After being mounted in the cavity 121 through the placement hole 124 of the upper cover 122, the accommodating portion 111 is perfectly shielded, thereby making the decorative cup simpler and more beautiful in appearance, and greatly improving the ornamental value of the decorative cup. A limiting column 113 is disposed on the transparent portion 112. A limiting hole 125 matched with the limiting column 113 is formed in the upper cover 122. The limiting column 113 is inserted into the limiting hole 125, and the limiting hole 125 limits and fixes the limiting column 113, so that the cup body 11 may be well prevented from moving, and fixed to the upper cover 122 very steadily. A threaded hole is formed in the limiting column 113. By matching of a screw and the threaded hole, the screw may fix the cup body 11 to the upper cover 122 very firmly. Meanwhile, this fixing mode is very convenient for removal, so that the cup body 11 may be removed very conveniently for cleaning or repairing, and the decorative cup is more durable and very convenient to use.

The base 12 includes a lower cover 123. Heat dissipation holes 126 are formed in the lower cover 123 at intervals. The heat dissipation holes 126 are disposed around the lower cover 123 by one circle. Through the arrangement of the heat dissipation holes 126, heat dissipation may be well performed on a water pump apparatus, so that the water pump apparatus may work in a very efficient and good way. As the heat dissipation holes 126 are disposed around the lower cover 123 by one circle, the decorative cup is higher in heat dissipation efficiency, and may perform the heat dissipation on the water pump apparatus more quickly to guarantee normal work of the water pump apparatus. Supporting protrusions 127 are also disposed on the lower cover 123. Three supporting protrusions 127 are disposed at intervals. The arrangement of the supporting protrusions 127 facilitates placement of the decorative cup, and may effectively prevent the decorative cup from sliding, so as to guarantee stable placement of the decorative cup. By the three supporting protrusions 127, the decorative cup is placed more stably. The water pump apparatus is disposed in an accommodating cavity. The water pump apparatus includes a water pump shell 21. A motor is disposed in the water pump shell 21. The water pump shell 21 may also provide a good protection for the motor to effectively prevent the motor from being pressed, thereby making the motor more durable.

A motor baffle plate 212 is disposed on the water pump shell 21. Through the arrangement of the motor baffle plate 212, the motor 23 is very convenient to mount and limit, and may be limited perfectly. A blade enclosure 214 is disposed on the motor baffle plate 212. The arrangement of the blade enclosure 214 may provide a good protection for blades 233 to enable the blades 233 to be more durable, and may provide a very good support for the water pump shell 21 to further improve the rigidity of the water pump shell 21. A first through hole 215 is formed in the blade enclosure 214. A blade fixing cover 25 is disposed on the blade enclosure 214 in a matched manner. A guide groove 251 matched with the first though hole 215 is formed in the blade fixing cover 25. The arrangement of the blade fixing cover 25 also may provide a very good protection for the blades 233 to effectively prevent the blades 233 from being damaged and greatly improve the durability of the blades 233. Due to the first though hole 215, water flows very conveniently. The guide groove 251 and the first through hole 215 are matched with each other to enable the water pump apparatus 2 to work more efficiently.

A guide protrusion 252 is disposed on the blade fixing cover 25 and is disposed along the edge of the guide groove 251. The guide protrusion 252 may well guide the water to a place near the motor 23, so that it is more convenient for the work of the blades 233. As the guide protrusion 252 is disposed along the edge of the guide groove 251, it is very convenient for processing and production of the blade fixing cover 25 and convenient for die opening manufacturing of the blade fixing cover 25, and the production cost is greatly reduced. The guide protrusion 252 is configured in an arc shape. The arc-shaped guide protrusion 252 may well reduce the resistance of the water, so that the water may flow to a place near the blades 233 better to facilitate the cooperative work of the motor 23 and the blades 233. A second through hole 253 is formed in the blade fixing cover 25. The first through hole 215 is communicated with the second through hole 253 in a matched manner to enable the water to flow more smoothly.

A shifting block 26 is disposed on the water pump shell 21, and includes a shifting block baffle plate 261. A shifting block inserting column 262 is disposed on the shifting block baffle plate 261. A baffle plate inserting hole 216 matched with the shifting block inserting column 262 is formed in the motor baffle plate 212. The shifting block inserting column 262 and the baffle plate inserting hole 216 are matched to limit the shifting block 26 perfectly. Furthermore, the shifting block inserting column 262 may do a rotating motion very easily in the baffle plate inserting hole 216, thereby greatly facilitating the operation of the shifting block 26. The shifting block baffle plate 261 and the water pump shell 21 are matched to greatly facilitate removal, cleaning or replacement of the shifting block 26, so that the shifting block 26 is more durable.

The water pump shell 21 includes a front fixed cover 27. The front fixed cover 27 may well press and fix the shifting block 26, so that the shifting block 26 may be perfectly limited and fixed by the front fixed cover 27. A handle through hole 271 is formed in the front fixed cover 27. A shifting block handle 263 matched with the handle through hole 271 is disposed on the shifting block 26. The shifting block baffle plate 261 is matched with the second through hole 253, and the shifting block handle 263 controls the movement of the shifting block baffle plate 261. The shifting block handle 263 and the handle through hole 271 are matched, so that the shifting block handle 263 is very convenient to operate. Furthermore, the handle through hole 271 may well limit the shifting block handle 263 to effectively limit a motion range of the shifting block handle 263, so that the shifting block 263 may be operated more conveniently and easily. The shifting block handle 263 is operated to enable the shifting block baffle plate 261 to shield the second through hole 253 in different degrees, thereby well controlling the outflow of the water flowing out from the second through hole 253 to well control a fluctuation caused by the water flow on a water surface, so that a more lifelike ornamental effect is simulated.

The water pump shell 21 includes a rear fixed cover 28. A buckling protrusion 283 is disposed on the rear fixed cover 28. A buckling groove 217 matched with the buckling protrusion 283 is formed in the water pump shell 21. The buckling protrusion 283 and the buckling groove 217 are matched with each other to fix the rear fixed cover 28 very firmly. The rear fixed cover 28 may well shield the inside of the water pump shell 21, so that the water pump apparatus 2 looks cleaner and tidier and more beautiful, and the decorative cup is higher in ornamental value. Diversion through holes 272 are formed in the front fixed cover 27. A plurality of diversion through holes 272 are disposed along the front fixed cover 27. The diversion through holes 272 may well divide the water flow formed by the water pump apparatus 2 to enable the water flow to be dispersed more uniformly and form a relatively uniform fluctuation on the water surface, so that the decorative cup is higher in ornamental value. Through the arrangement of the plurality of diversion through holes 272, a better diversion effect is achieved and a better ornamental effect is generated. The rear fixed cover 28 includes a first rear cover 281 and a second rear cover 282. A rear cover through hole 284 is formed in the first rear cover 281. The rear fixed cover 28 is disassembled into the first rear cover 281 and the second rear cover 282, so that the rear fixed cover 28 may be better used. A connecting wire connected with the motor 23 may be connected with the motor 23 through the rear cover through hole 284, so that the second rear cover 282 is not required to be removed if a wire connecting condition is required to be maintained, which makes the maintenance operation very convenient and easy.

A water pump fixing frame 29 is disposed on the water pump shell 21. The water pump fixing frame 29 may fix the water pump shell 21 to the shell 1 perfectly to effectively fix and limit the water pump apparatus 2. The water pump fixing frame 29 includes supporting columns 291 and fixing buckles 292. The fixing buckles 292 are matched with the water pump shell 21, and the supporting columns 291 are matched with the shell 1, so as to clamp and fix the water pump shell 21. The supporting columns 291 may provide a good support for the water pump apparatus 2 to enhance the supporting for the water pump apparatus 2 and effectively prevent the water pump apparatus 2 from being pressed and damaged, thereby protecting the water pump apparatus 2 very effectively. The fixing buckles 292 firmly fix the water pump apparatus 2 with the water pump fixing frame 29, thereby better protecting the water pump apparatus 2. Meanwhile, this fixing mode is very convenient for removal of the water pump apparatus 2, so that the water pump apparatus 2 is very convenient and easy to maintain.

The decorative cup includes a circuit board 3. Light emitting diode (LED) lamps 31 are disposed on the circuit board 3. At least two LED lamps 31 are disposed. The LED lamps 31 may be designed in different colors respectively. If the pure water or tap water is accommodated in the decorative cup, the cup body 11 is more crystal clear through irradiation of the LED lamps 31, so that the ornamental value of the decorative cup is improved. Through the irradiation of the LED lamps 31 with different colors, the decorative cup presents different colors, so that the decorative cup is more colorful and higher in ornamental value.

A transparent water pipe and a decorative water tap or a decorative tea pot and the like may be disposed in the decorative cup, so as to create a suspended hanging effect. It seems that no hanger and support is provided at all, and water looks more like continuously flowing out from the decorative water tap or a decorative water bottle. Furthermore, the LED lamps 31 may change the colors continuously to make the decorative water bottle more mysterious under the irradiation of the light.

When the decorative cup is placed in an office, several goldfishes are raised in the decorative cup, which will make people pleasant and delightful and also achieve a best effect of watching and furnishing, thereby bringing pleasant feeling to people.

The above contents are further detailed descriptions of the present disclosure in combination with specific preferred implementation manners. However, the specific implementation of the present disclosure shall not be considered to be only limited to these descriptions. For those ordinary skilled in the art to which the present disclosure belongs, several simple deductions or replacements may be made without departing from the conception of the present disclosure, all of which shall be considered to belong to the protection scope of the present disclosure.

The invention claimed is:

1. A decorative cup, comprising a shell, wherein the shell comprises a cup body and a base; the cup body comprises an accommodating portion and a transparent portion; a cavity is formed in the base; the accommodating portion is disposed in the cavity; and the transparent portion is made of a transparent material and shaped as a polygon prism, wherein the base comprises an upper cover; a placement hole matched with the accommodating portion is formed in the upper cover; a limiting column is disposed on the transparent portion; a limiting hole matched with the limiting column is formed in the upper cover; and a threaded hole is formed in the limiting column.

2. The decorative cup according to claim 1, wherein the base comprises a lower cover; heat dissipation holes are formed in the lower cover at intervals; the heat dissipation holes are disposed around the lower cover by one circle; supporting protrusions are also disposed on the lower cover; the supporting protrusions are disposed at intervals; a water pump apparatus is disposed in the accommodating portion; the water pump apparatus comprises a water pump shell; and a motor is disposed in the water pump shell.

3. The decorative cup according to claim 2, wherein a motor baffle plate is disposed on the water pump shell; a blade enclosure is disposed on the motor baffle plate; a first through hole is formed in the blade enclosure; a blade fixing cover is disposed on the blade enclosure in a matched manner; and a guide groove matched with the first through hole is formed in the blade fixing cover.

4. The decorative cup according to claim 3, wherein a guide protrusion is disposed on the blade fixing cover and is disposed along an edge of the guide groove; the guide protrusion is configured in an are shape; a second through hole is formed in the blade fixing cover; and the first through hole is communicated with the second through hole in a matched manner.

5. The decorative cup according to claim 4, wherein a shifting block is disposed on the water pump shell; the shifting block comprises a shifting block baffle plate; a shifting block inserting column is disposed on the shifting block baffle plate; and a baffle plate inserting hole matched with the shifting block inserting column is formed in the motor baffle plate.

6. The decorative cup according to claim 5, wherein the water pump shell comprises a front fixed cover; a handle through hole is formed in the front fixed cover; a shifting block handle matched with the handle through hole is disposed on the shifting block; the shifting block baffle plate is matched with the second though hole; and the shifting block handle controls the movement of the shifting block baffle plate.

7. The decorative cup according to claim 6, wherein the water pump shell comprises a rear fixed cover; a buckling protrusion is disposed on the rear fixed cover; a buckling groove matched with the buckling protrusion is formed in the water pump shell; the front fixed cover defines a plurality of diversion through holes; the rear fixed cover comprises a first rear cover and a second rear cover; and a rear cover through hole is formed in the first rear cover.

8. The decorative cup according to claim 7, wherein a water pump fixing frame is disposed on the water pump shell; the water pump fixing frame comprises supporting columns and fixing buckles; the fixing buckles are matched with the water pump shell; and the supporting columns are matched with the shell, so as to clamp and fix the water pump shell.

9. The decorative cup according to claim 1, wherein the decorative cup comprises a circuit board; at least two light emitting diode (LED) lamps are disposed on the circuit board; and the at least two LED lamps may be designed in different colors respectively.

10. The decorative cup according to claim 2, wherein the decorative cup comprises a circuit board; at least two light emitting diode (LED) lamps are disposed on the circuit board; and the at least two LED lamps may be designed in different colors respectively.

11. The decorative cup according to claim 3, wherein the decorative cup comprises a circuit board; at least two light emitting diode (LED) lamps are disposed on the circuit board; and the at least two LED lamps may be designed in different colors respectively.

12. The decorative cup according to claim 4, wherein the decorative cup comprises a circuit board; at least two light emitting diode (LED) lamps are disposed on the circuit board; and the at least two LED lamps may be designed in different colors respectively.

13. The decorative cup according to claim 5, wherein the decorative cup comprises a circuit board; at least two light emitting diode (LED) lamps are disposed on the circuit board; and the at least two LED lamps may be designed in different colors respectively.

14. The decorative cup according to claim 6, wherein the decorative cup comprises a circuit board; at least two light emitting diode (LED) lamps are disposed on the circuit board; and the at least two LED lamps may be designed in different colors respectively.

15. The decorative cup according to claim 7, wherein the decorative cup comprises a circuit board; at least two light emitting diode (LED) lamps are disposed on the circuit board; and the at least two LED lamps may be designed in different colors respectively.

16. The decorative cup according to claim 8, wherein the decorative cup comprises a circuit board; at least two light emitting diode (LED) lamps are disposed on the circuit board; and the at least two LED lamps may be designed in different colors respectively.

* * * * *